US005421765A

United States Patent [19]

Lehmann et al.

[11] Patent Number: 5,421,765

[45] Date of Patent: Jun. 6, 1995

[54] TOY TATTOO PLAYSET

[76] Inventors: Roger W. Lehmann; Michael I. Satten, both of Edison Corporate Center, 3100 Woodbridge Ave,, Suite 102, Edison, N.J. 08837

[21] Appl. No.: 238,153

[22] Filed: May 4, 1994

[51] Int. Cl.[6] ..... A63H 3/00; A63H 33/30

[52] U.S. Cl. ..... 446/296; 446/73; 446/475; 446/901; 446/472

[58] Field of Search ..... 446/296, 475, 901, 491, 446/71, 72, 73, 75, 472

[56] References Cited

U.S. PATENT DOCUMENTS 5,282,631 2/1994 Baker ..... 446/901 X 5,318,469 6/1994 Unalp et al. ..... 446/475 X

*Primary Examiner*—Mickey Yu

*Attorney, Agent, or Firm*—Stoll, Miskin, Previto & Hoffman

[57] ABSTRACT

Playsets having a toy element, such as a doll or stuffed animal, a combination dispenser, moisturizer and hairbrush handset and simulated tattoos. The simulated tattoos are nontoxic water-soluble adhesive-backed prints having decorative designs and/or legends simulating play markings or play tattoos adapted to be placed on either or both the toy element and/or the child, or transferred between them. The handset stores the simulated tattoo on a roll for dispensing, contains water storage, pump and atomizer to moisten the tattoos for application, transfer or removal, and a hairbrush for doll and child use.

13 Claims, 4 Drawing Sheets

FIG. 1
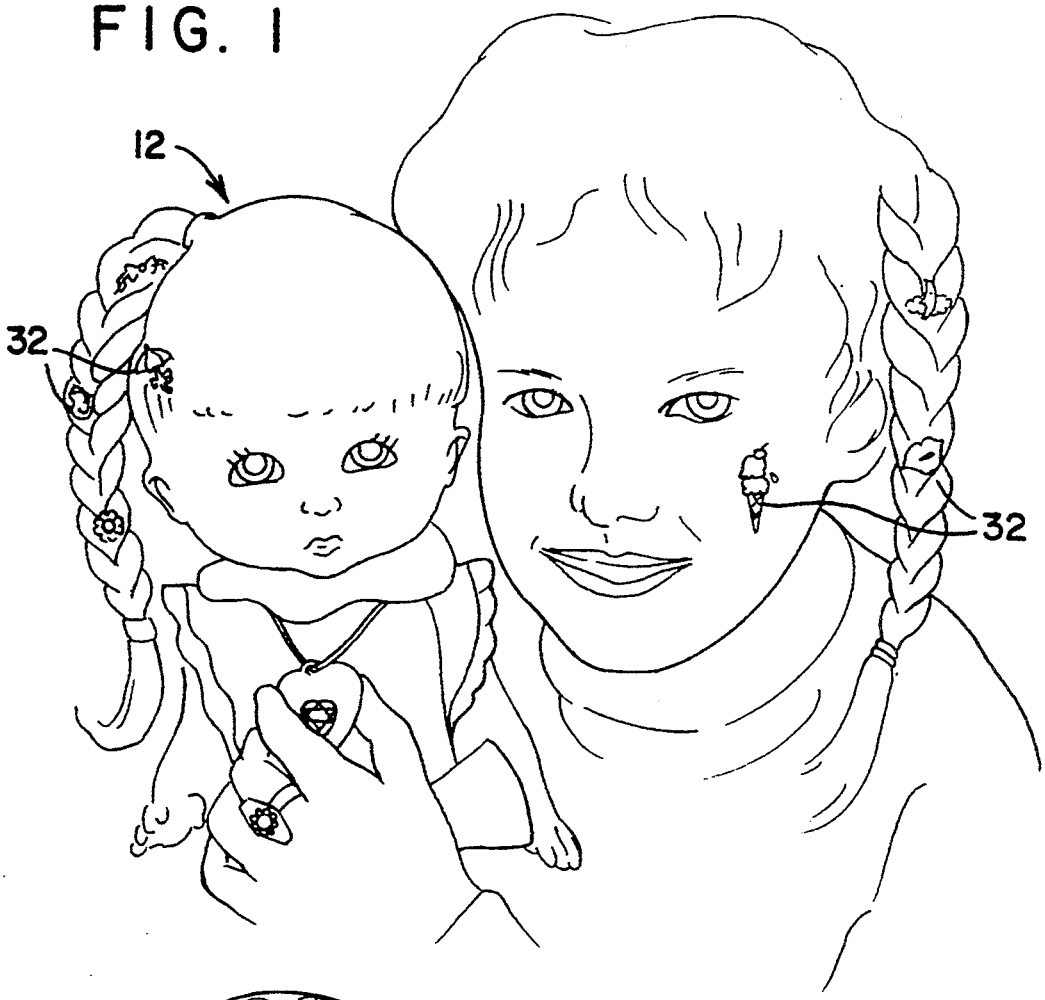
FIG. 2
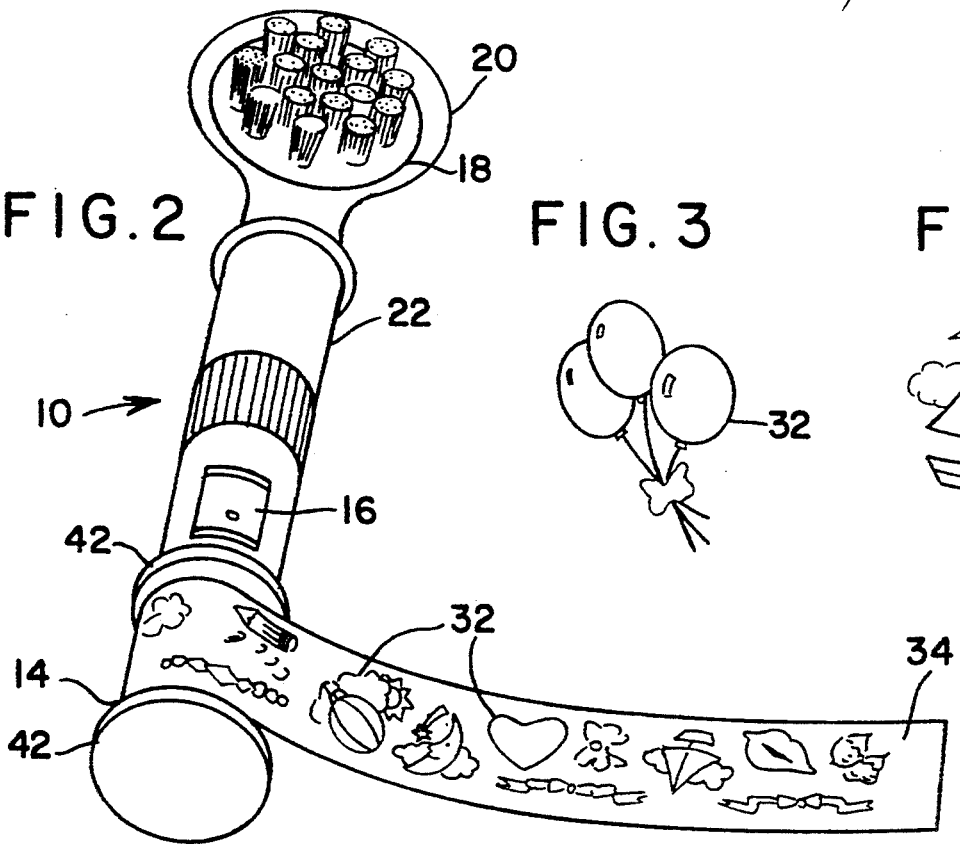
FIG. 3
FIG. 4
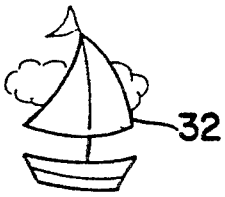

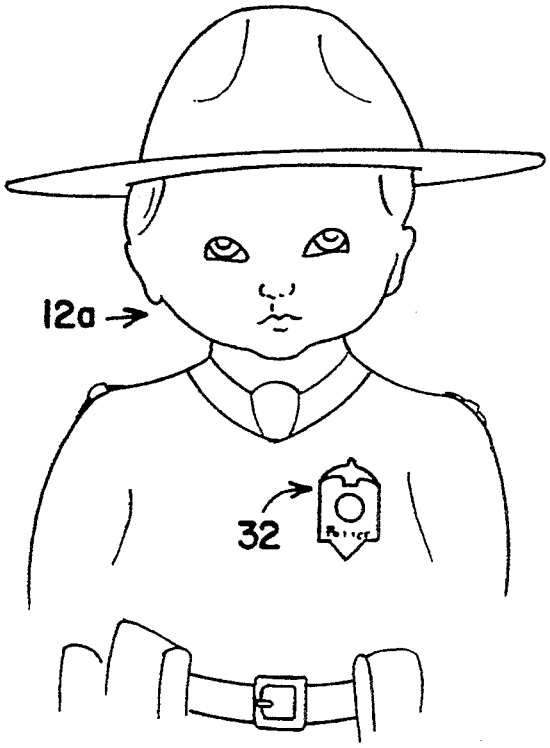
FIG. 5
FIG. 6
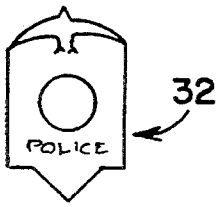
FIG. 7
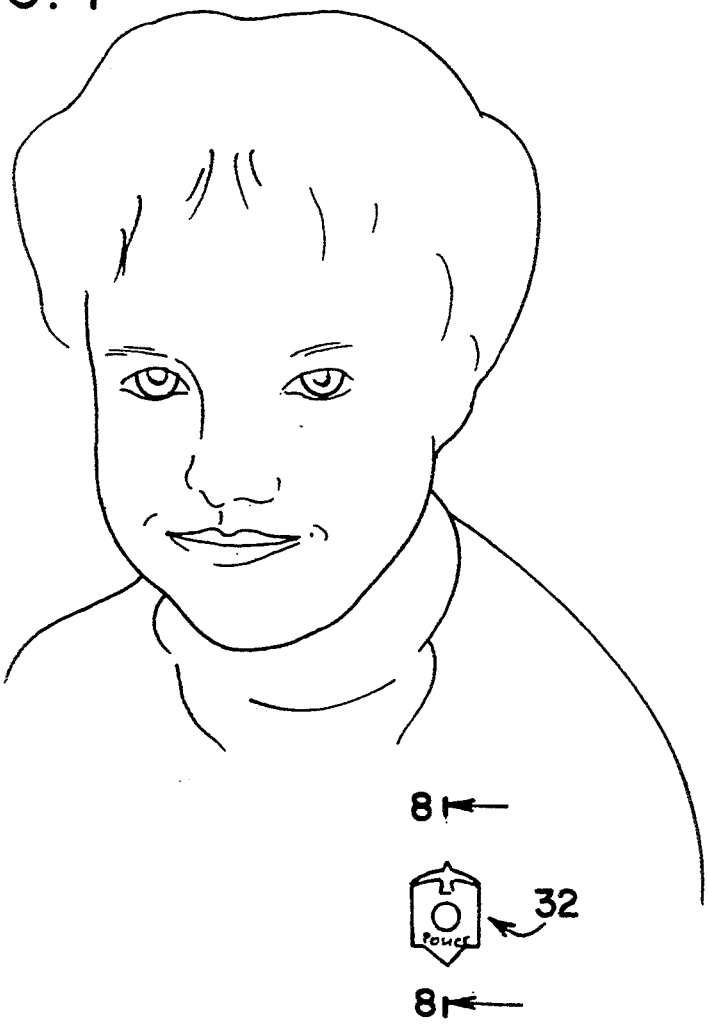
FIG. 8
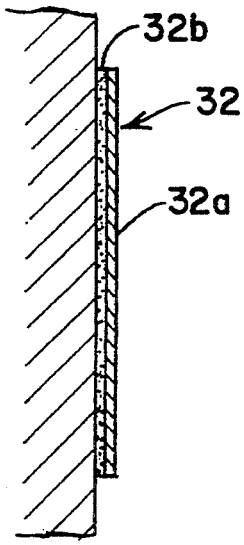

TOY TATTOO PLAYSET

BACKGROUND OF THE INVENTION

Actual tattoos are indelible designs, legends and/or pictures applied by pigments just beneath the skin by puncturing the skin. As such they are notably improper for children's use. Designs, pictures and/or legends applied to children for play or educational purposes must be safe, removable, non-toxic and of course utilize no puncturing of the skin. The term tattoo as used herein should not be taken as referring to the technically accurate definition for the word tattoo.

While most toys are meant to be played with by children, and while some toys are more interactive than others, inviting an increased interaction between the child and the toy, many of the present interactive toys are of the electronic or computer game type which, while they have some play value, are costly, noisy, require some power source and at times force themselves on a child rather than provide the child with the means to play quietly and imaginatively.

SUMMARY OF THE INVENTION

The present invention utilizes a simple doll or stuffed animal for a toy playset which encourages quiet interaction between child and toy, imagination and in some versions may be educational or provide role-model support.

The present invention utilizes a combination of a (a) toy such as a doll, (b) designs, pictures and/or legends ("simulated tattoos"), and (c) a handset which has at least storage and applicator functions for the simulated tattoos, to allow the child to apply the simulated tattoos to the toy or to the child him/herself. The combination allows the simulated tattoos to be transposed between child and toy or removed from both. In a preferred embodiment, the simulated tattoos are intended for placement in the child's and doll's hair, and the handset has a child's haircare appliance such as a hairbrush. The haircare appliance stores the simulated tattoos, has an atomizer to moisten the water soluble adhesive on the backs of the simulated tattoos and accordingly permits the child to dress up the doll and the child with hair designs and brush the hair of both.

In educational or training versions, the simulated tattoos may have alphabet characters or simple words and picture their corresponding meanings (e.g.—cow with a picture of a cow) for elementary reading comprehension and reinforcement, or simple color match or shape match type designs to assist the learning impaired or for the very young. In role model versions, the designs may be, for example, of police badges and the doll a representation of a policeman or policewoman.

BRIEF DESCRIPTION OF THE DRAWING

In the drawing:

FIG. 1 is a pictorial representation of a child and a doll, each with illustrative examples of the simulated tattoos of the inventor.

FIG. 2 is a perspective view of the handset means of the invention showing illustrative examples of the simulated tattoos of the invention being dispensed.

FIGS. 3 and 4 are enlarged illustrative examples of designs of the simulated tattoos of the invention.

FIG. 5 is a pictorial representation of a police doll of the invention showing an illustrative example of a police badge version of the simulated tattoo of the invention.

FIG. 6 is an enlarged view of the simulated tattoo of FIG. 5.

FIG. 7 is a pictorial representation of a child wearing the simulated tattoo of FIG. 5.

FIG. 8 is a cross-sectional view taken across line 8—8 of FIG. 7.

DESCRIPTION OF A PREFERRED EMBODIMENT

Figure 9:
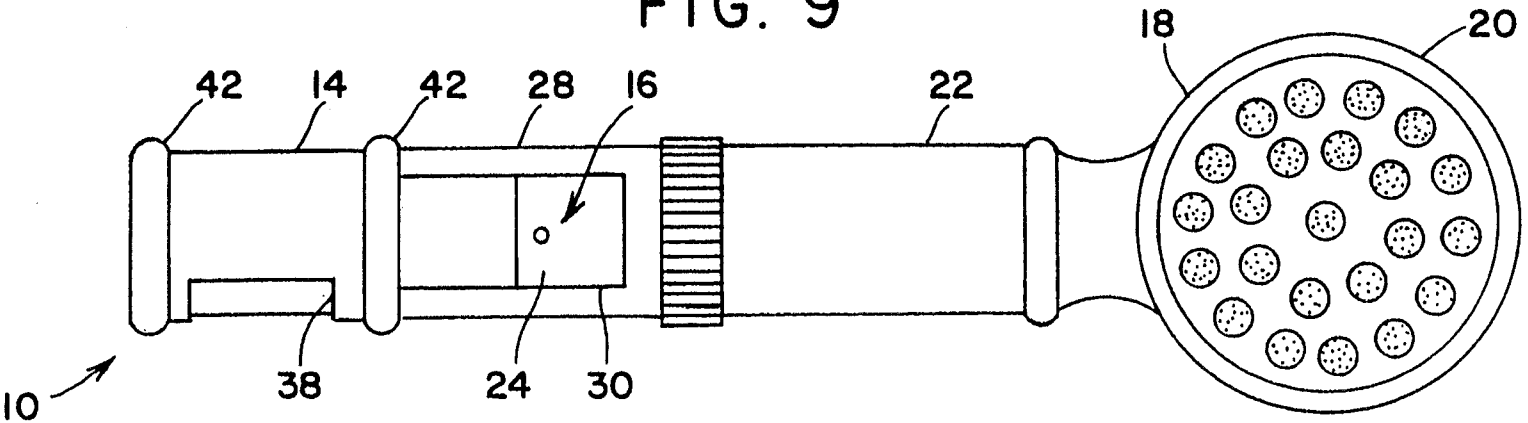
FIG. 9 is a front view of the handset means of the invention.
Figure 10:
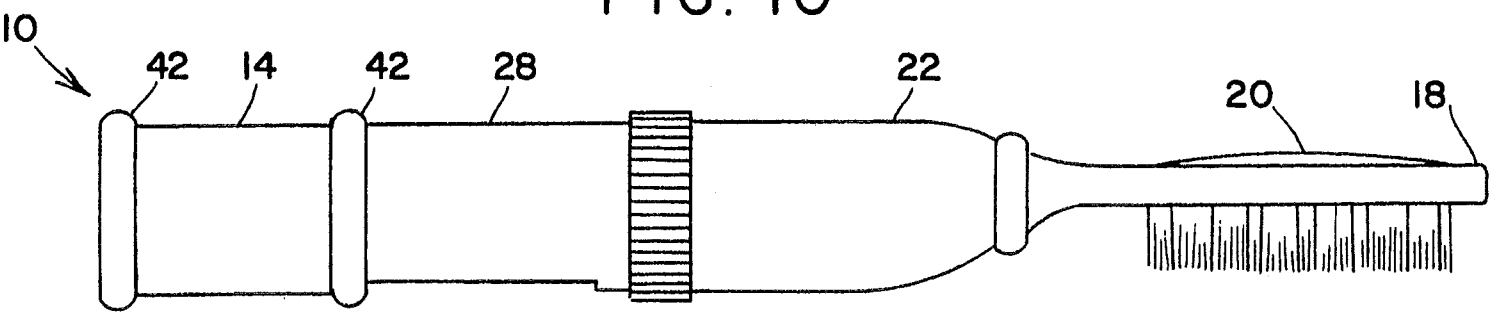
FIG. 10 is a side view of the handset means of FIG. 9.

With reference to the drawing, the toy tattoo playset means of the invention comprises handset means 10 and toy element means 12 such as a doll. Handset means 10, generally shaped to be held by a child, comprises dispenser means 14, moisturizer means 16 and hair appliance means 18 such as a hairbrush having a brush head 20 and attached handle means 22.

Handle means 22 is substantially hollow, having recess or cavity 23, and is adapted to receive all or part of moisturizer means 16, which comprises a pump spray head 24 and which screws onto handle means 22. Preferably an atomizer, spraying as little water as will serve its purpose without dripping or mess, moisturizer means 16 is washable and refillable so that the water supply is kept clean and fresh. Recess 23 of handle means 22 can hold water when pump spray head 24 is screwed onto handle means 22. An aperture portion 28 removably attaches to and becomes a removable part of handle means 22. Aperture portion 28 holds dispenser means 14 in position in handle means 22 and an opening 30 in aperture portion 28 exposes pump spray head 24 to access by a child's finger.

Figure 11:
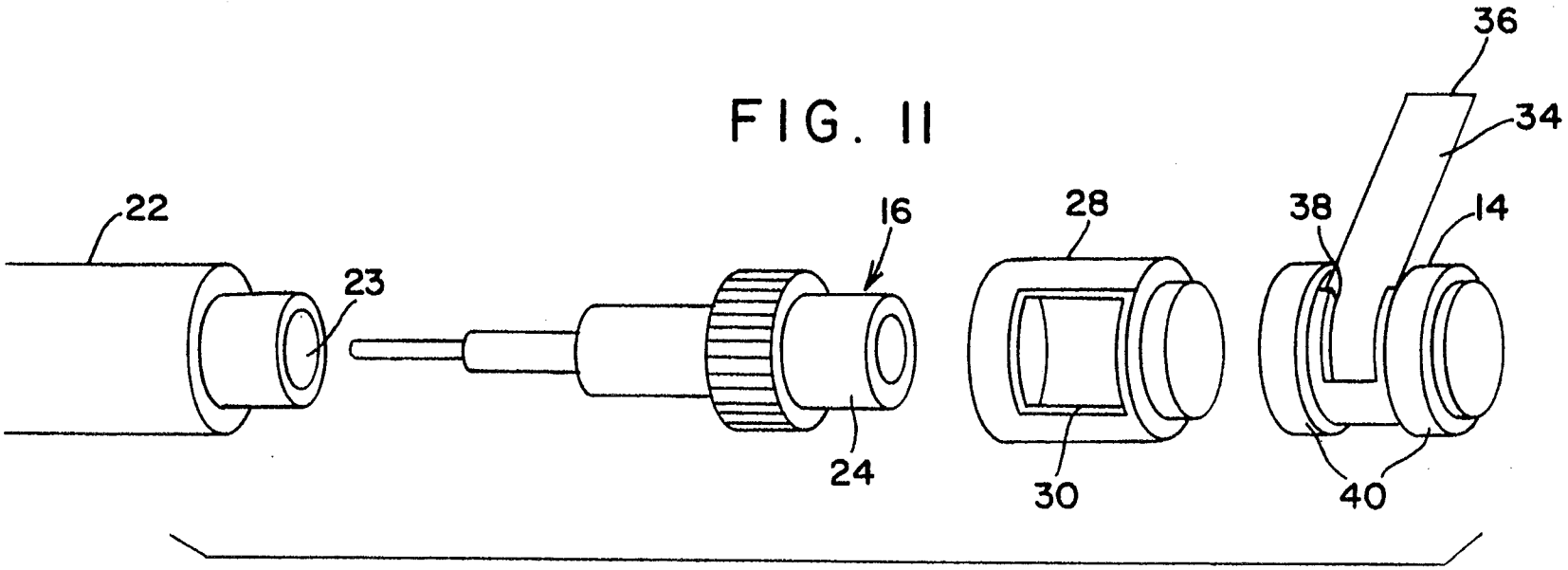
FIG. 11 is an exploded fragmentary view of the handset means of the invention showing a roll of simulated tattoos partly dispensed.
Figure 12:
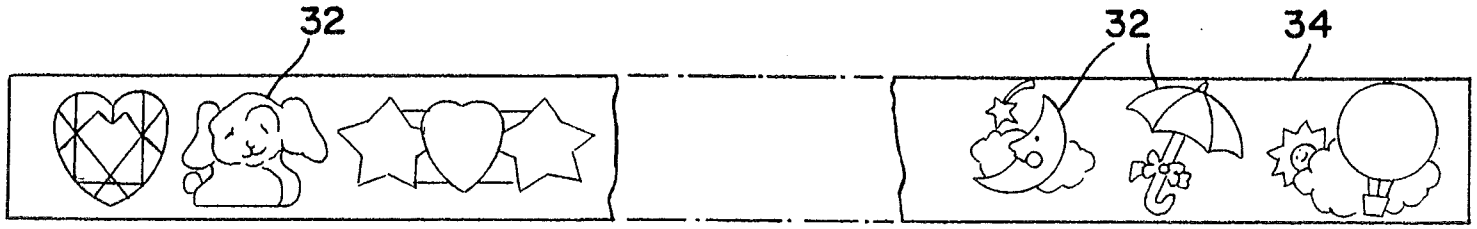
FIG. 12 is a plan view of illustrative simulated tattoos on a strip of paper release means of the invention.

Dispenser means 14 removably attaches to aperture portion 28 on the side opposite brush head 20 and becomes a removable part of handle means 22. Dispenser means 14 is adapted to accommodate a plurality of simulated tattoos 32 in dispensable form, preferably on roll of release paper 34. Dispenser means 14 retains or contains the roll of release paper 34 for dispensing. In the preferred embodiment, release paper is $\frac{3}{4}$ of an inch wide and 20 inches long, in a roll contained within dispenser means 14, and withdrawable by pulling the roll end 36 out of an access port or slot 38 as shown in FIG. 11.

If too much release paper 34 is pulled out, the exterior of dispenser means 14 may be contoured to receive and hold the excess if wrapped around its periphery as shown in FIG. 2. Such contouring may be formed by a pair of end caps 40 or a pair of circumferential ribs 42 on opposite ends of dispenser means 14. The distance between each of the pair of endcaps 40, or between each of the pair of circumferential ribs 42, is substantially equal to the width of release paper 34 to removably hold it in position on dispenser means 14. Release paper 14 is designed to hold simulated tattoos 32 until needed, and then to allow them to be selectively removed as by peeling off.

Each simulated tattoo 32 comprises a front image surface 32*a* which carries (or itself is, as in a die-cut design) the visible design of the simulated tattoo, and an adhesive backing means 32*b* adapted to be removably secured to either or both toy element means 12 and the child, although not at the same time for a single tattoo. By providing adhesive backing means 32*b* adapted to place the tattoos on and removed from the hair or the surface or clothing of toy element means 12, and on or removed from the hair or on the skin or clothing of the child, there are created attachable, removable and transferrable simulated tattoos of enhanced child interest, interaction and play value. Adhesive backing means 32b is non-toxic, non-permanent and preferably water-soluble, with moistening for application to and removal from toy or child being by atomized water spray from moisturizer means 16. The atomized water spray in combination with hairbrush 20 also encourages child grooming.

Toy element means 12 may be a doll of conventional baby or young child design as shown schematically in FIG. 1, or of a role model design as shown in FIG. 5 wherein toy element means 12*a* is a representation of a policeman or policewoman or state trooper and the simulated tattoo 32 design is that of a simulated police-type badge. The illustrations in the drawing are not intended to be gender-specific.

Toy tattoo playset means of the type indicated is being marketed to the retail trade under the name TATTOODLES TM by All Star Toys of New York or another licensee of the inventors.

What is claimed is:

1. Toy tattoo playset means, comprising:

a. toy element means, said toy element means comprising a surface at least a portion of which is covered with hair-like material, b. simulated tattoo means, said simulated tattoo means being removably affixable to said toy element means and to a child, said simulated tattoo means being removably attached to a roll of release paper means and c. simulated tattoo dispenser means, said simulated tattoo dispenser means being adapted to be hand held and to dispense said simulated tattoo means, said simulated tattoo dispenser means being adapted to receive, hold and permit access to said roll of release paper means d. said simulated tattoo dispenser means additionally comprising removable end cap means to permit said roll of release paper means to be inserted therewithin and access means adapted to permit a strip of said roll of release paper means to be selectively withdrawn.

2. Toy tattoo playset means in accordance with claim 1, wherein:

said toy element means comprises a doll.

3. Toy tattoo playset means in accordance with claim 2, wherein:

said simulated tattoo means are removably affixable to the hair-like material of said toy element means and to the hair of the child.

4. Toy tattoo playset means in accordance with claim 1, wherein:

said simulated tattoo means are removably affixable to the hair-like material of said toy element means and to the hair of the child.

5. Toy tattoo playset means in accordance with claim 1, wherein:

said toy element means comprises a stuffed animal.

6. Toy tattoo playset means, comprising:

a. toy element means, b. simulated tattoo means, said simulated tattoo means being removably affixable to said toy element means and to a child, c. handset means, said handset means comprising simulated tattoo dispenser means for dispensing said simulated tattoo means, d. said toy element means comprising a doll and e. said handset means additionally comprising hair appliance means.

7. Toy tattoo playset means in accordance with claim 6, wherein:

a. said simulated tattoo means comprises water-soluble adhesive backed means and b. said handset means additionally comprises moisturizer device means.

8. Toy tattoo playset means in accordance with claim 7, wherein:

said handset means additionally comprises hollow handle means adapted to receive at least a portion of said moisturizer device means.

9. Toy tattoo playset means in accordance with claim 8, wherein:

a. said handset means additionally comprises aperture means and b. said moisturizer device means comprises storage means and spray means, said hollow handle means being adapted to receive said storage means and said aperture means being adapted to expose said spray means for activation.

10. Toy tattoo playset means in accordance with claim 6, wherein:

a. said simulated tattoo means are removably attached to a roll of release paper means and b. said simulated tattoo dispenser means being adapted to receive, hold and permit access to said roll of release paper means.

11. Toy tattoo playset means in accordance with claim 10, wherein:

said simulated tattoo dispenser means additionally comprises removable end cap means to permit said roll of release paper means to be inserted therewithin and access means adapted to permit a strip of said roll of release paper means to be selectively withdrawn.

12. Toy tattoo playset means in accordance with claim 10 or 11, wherein:

said simulated tattoo dispenser means additionally comprises a pair of raised circumferential rib means spaced from each other by a distance substantially equal to the width of the release paper in said roll of release paper means.

13. Toy tattoo playset means, comprising:

a. toy element means, said toy element means comprising a surface at least a portion of which is covered with hair-like material.

b. simulated tattoo means, said simulated tattoo means being removably affixable to said toy element means and to a child, said simulated tattoo mean being removably attached to a roll of release paper means and c. simulated tattoo dispenser means, said simulated tattoo dispenser means being adapted to be hand held and to dispense said simulated tattoo means, said simulated tattoo dispenser means being adapted to receive, hold and permit access to said roll of release paper means, d. said simulated tattoo dispenser means additionally comprises a pair of raised circumferential rib means spaced from each other by a distance substantially equal to the width of the release paper in said roll of release paper means.

* * * * *